US007934935B1

(12) United States Patent
Gao

(10) Patent No.: US 7,934,935 B1
(45) Date of Patent: May 3, 2011

(54) LOCKING DOOR FOR AN ELECTRICAL OUTLET

(75) Inventor: Shaohua Gao, Pinghu (CN)

(73) Assignee: Zhejiang Trimone Electric Science and Technology Co. Ltd., Pinghu, Zhejiang Province (CN)

( * ) Notice: Subject to any disclaimer, the term of this patent is extended or adjusted under 35 U.S.C. 154(b) by 0 days.

(21) Appl. No.: 12/792,719

(22) Filed: Jun. 2, 2010

(30) Foreign Application Priority Data

Oct. 20, 2009 (CN) ..... 2009 1 0153580

(51) Int. Cl.
*H01R 13/44* (2006.01)

(52) U.S. Cl. ..... 439/137

(58) Field of Classification Search ..... 439/135, 439/140, 145, 137
See application file for complete search history.

(56) References Cited

U.S. PATENT DOCUMENTS

| | | | | |
|---|---|---|---|---|
| 2,552,061 | A | 5/1951 | Popp | |
| 2,610,999 | A | 9/1952 | Silver | |
| 4,595,894 | A | 6/1986 | Doyle et al. | |
| 5,006,075 | A * | 4/1991 | Bowden, Jr. | 439/137 |
| 5,915,981 | A * | 6/1999 | Mehta | 439/137 |
| 6,086,391 | A * | 7/2000 | Chiu | 439/145 |
| 6,555,771 | B2 * | 4/2003 | Shao | 439/137 |
| 7,179,992 | B1 * | 2/2007 | Packard et al. | 174/53 |
| 7,355,117 | B2 | 4/2008 | Castaldo et al. | |
| 7,452,221 | B1 * | 11/2008 | Oddsen et al. | 439/137 |
| 7,510,412 | B1 * | 3/2009 | Valentin | 439/145 |
| 7,645,149 | B2 * | 1/2010 | Carbone et al. | 439/137 |
| 2007/0114053 | A1 * | 5/2007 | Castaldo et al. | 174/53 |

OTHER PUBLICATIONS

Gao, Shaohua, U.S. Appl. No. 12/792,715, "Locking Protective Doors for Electrical Sockets" filed Jun. 2, 2010, 25 pages.

* cited by examiner

*Primary Examiner* — Briggitte R Hammond
(74) *Attorney, Agent, or Firm* — Mei & Mark LLP

(57) ABSTRACT

An electrical socket with a locking protective door may comprise an upper cover comprising first and second upper ports, and a bottom case configured to couple with the upper cover. The bottom case may comprise a pair of socket terminals. A middle frame may be between the upper cover and the bottom case. A protective door may be between the upper cover and the middle frame. A lock mounting guide plate may be coupled to the middle frame and may comprise first and second guide plate ports. The first and second upper ports may vertically align with the pair of socket terminals. The first and second guide plate ports may vertically align with the pair of socket terminals. When the protective door is in a first position, it prevents access to the first and second guide plate ports. And, when the protective door is in a second position, it provides access to the first and second guide plate ports.

15 Claims, 5 Drawing Sheets

Detail A (3:1) Detail B (3:1) Detail C

LOCKING DOOR FOR AN ELECTRICAL OUTLET

This application claims the benefit of priority of Chinese patent application 200910153580.7, filed Oct. 20, 2009, the contents of which are incorporated herein by reference in their entirety.

This application is related to the U.S. patent application Ser. No. 12/792,715 entitled "Locking Protective Doors for Electrical Sockets" filed Jun. 2, 2010 by Shaohua Gao.

TECHNICAL FIELD

The present disclosure relates generally to a protective door for an electrical socket.

BACKGROUND

Current technologies for the equipment and operation of electrical current distribution in household or commercial buildings provides transmission of current to electrical appliances. In such a distribution system, a traditional electrical socket consists of a pair of T holes or jacks, which are aligned with electrical plug bush connections. The pins of an electrical plug can be inserted into the jacks and achieve an electrical connection with the plug bush connections in the socket directly. Because most of such sockets are used in dwelling buildings and are located near the ground, a latent electric shocking danger exists for children and infants. For example, they may insert small objects into the jacks. Moreover, when electrical contact occurs with a wet mouth of a child, an electrical passage from the live line through the body of the child to the ground will be formed, resulting in a grounding failure and burning or electrical shocking. Besides fingers and mouth, the children may also insert various conductive materials such as metal objects into the sockets. Many such objects are commonly used ones, such as clips, electroprobes, hairpins, matchsticks, keys and coils. Believing such objects are safe, some parents do not restrict contact with them. For this reason, every dwelling building is required to have installed protective electrical sockets and grounding failure breakers in the current distribution system of the whole building.

As for the currently available circuit breaking device, e.g. the device described in U.S. Pat. No. 4,595,894, jointly owned, a tripping device is used to break the electrical connection among one or more input/output wires mechanically. Such a device can be reset after it trips when finding a grounding failure. However, the grounding failure current breaker only breaks the current after the current is contacted. Therefore, unless there is a protective electrical socket, the persons may still undergo the initial temporary electric shocking. The other patents, such as U.S. Pat. Nos. 2,552,061 and 2,610,999 are characterized by a notched sliding plate on the upper cover. It must be removed manually to match the notched sliding plate being covered to allow plugging in or unplugging off the electrical socket notch. The sliding closing plate provides the socket with better protection, while adding an extra material layer between the plug pins and the socket connections. This reduces the contact area between the plug pins and the connections, resulting in a latent temperature rise or a dangerous electric arc. The manually moveable plate has another shortage: children, through observation, may learn to expose the electrical socket. U.S. Pat. No. 7,355,117 mentions a protective electrical socket with an automatic resetting sliding block in it. However, because of the structural restriction of the sliding block in such a protective electrical socket, the material consumption and the fabrication cost are high.

SUMMARY

Therefore, applicant proposes an electrical socket with a locking protective door that can prevent insertion of foreign objects other than the electrical plug pins. The device can achieve the protection function with a simple structure and a low fabrication cost.

In one embodiment, an electrical socket with a locking protective door comprises an upper cover comprising a first upper port and a second upper port, and a bottom case configured to cooperatively couple with the upper cover. The bottom case may comprise at least one pair of socket terminals. A middle frame may be between the upper cover and the bottom case, the middle frame may comprise mounting brackets. A protective door may be between the upper cover and the middle frame. A lock mounting guide plate may be coupled to the middle frame, the lock mounting guide plate may comprise a first guide plate port and a second guide plate port.

The first upper port and the second upper port may correspond to and vertically align with the at least one pair of socket terminals. The first guide plate port and the second guide plate port may correspond to and vertically align with the at least one pair of socket terminals.

When the protective door is in a first position, the protective door prevents access to the first guide plate port and the second guide plate port. And, when the protective door is in a second position, the protective door provides access to the first guide plate port and the second guide plate port.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention.

FIG. 5 is a schematic of an exemplary.

DETAILED DESCRIPTION

Figure 1:
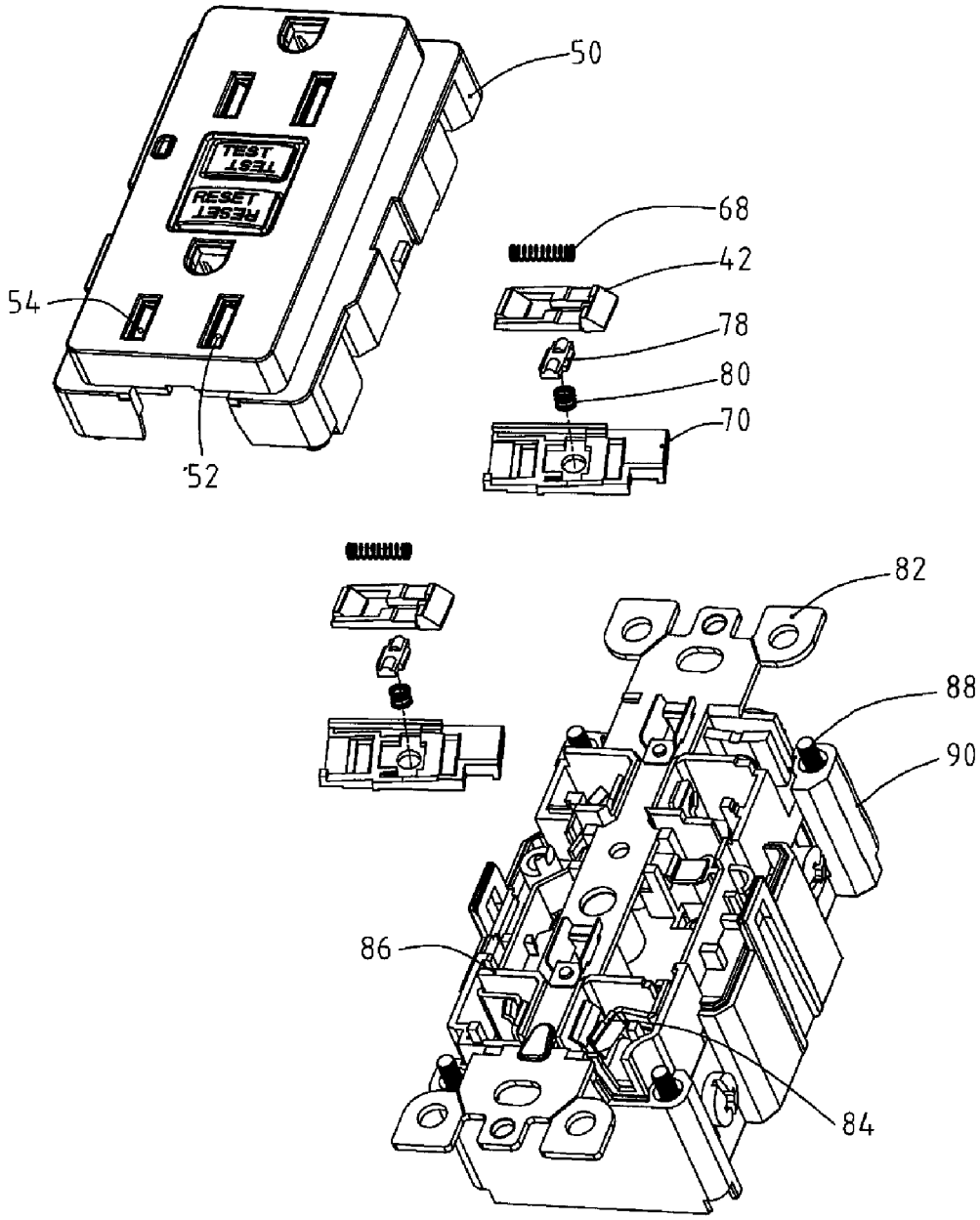
FIG. 1 is an exemplary schematic diagram of an embodiment.
Figure 2:
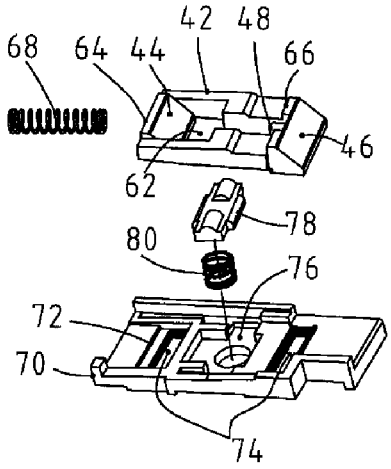
FIG. 2 is an exemplary schematic diagram of a protective door and lock mounting guide plate.
Figure 3:
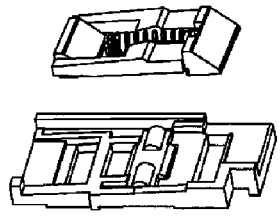
FIG. 3 is an exemplary partial breakdown schematic diagram of a protective door and lock mounting guide plate.
Figure 4:
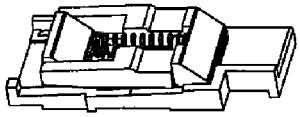
FIG. 4 is an exemplary assembly schematic diagram of the protective door and lock mounting guide plate.
Figure 5:
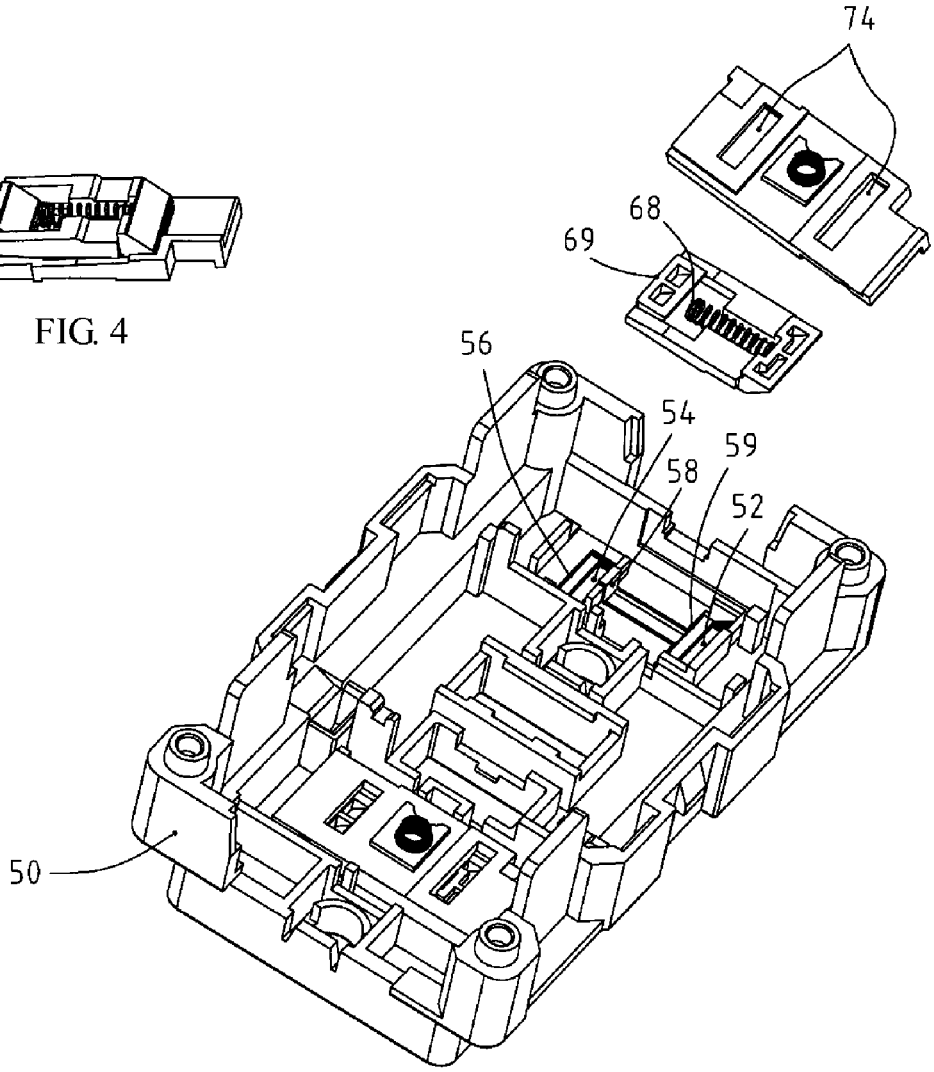
FIG. 5 is an exemplary assembly schematic diagram of the protective door, lock mounting guide plate, and upper cover.
Figure 6:
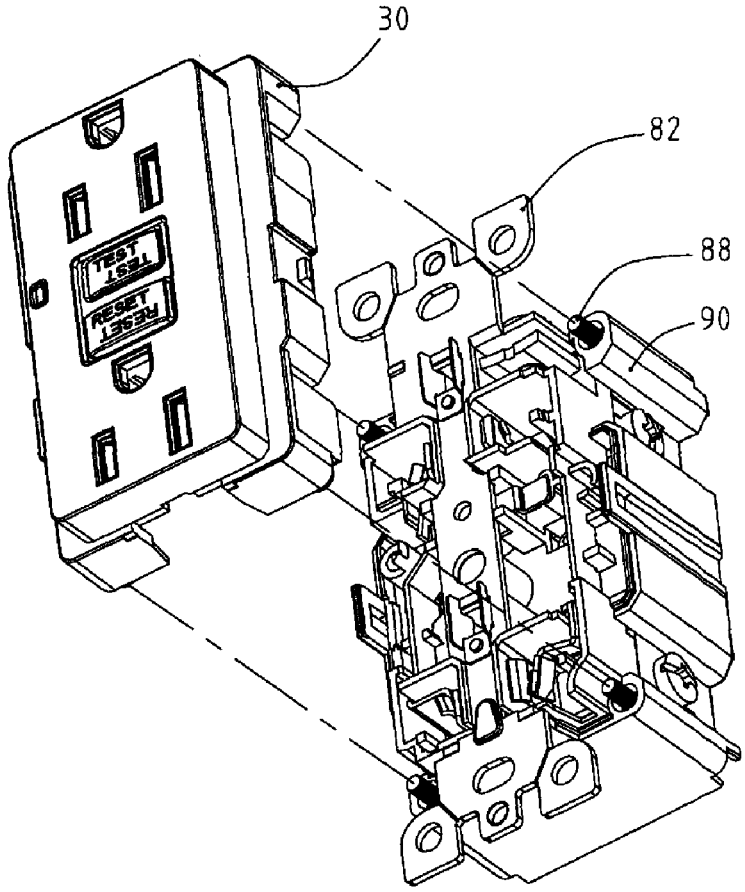
FIG. 6 is an exemplary partial breakdown schematic diagram of an embodiment.
Figure 7:
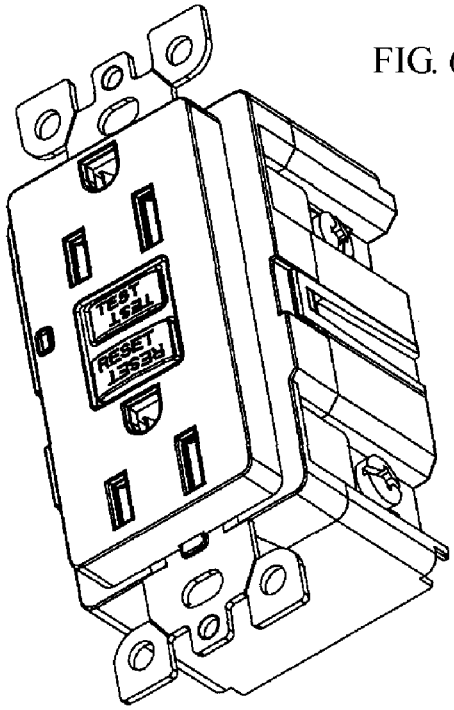
FIG. 7 is an exemplary assembly schematic diagram of an embodiment.

Reference will now be made in detail to the present exemplary embodiments, examples of which are illustrated in the accompanying drawings. Wherever possible, the same reference numbers will be used throughout the drawings to refer to the same or like parts.

As shown in the examples in FIG. 1 thru FIG. 12B, an electrical socket is equipped with a locking protective door. It is composed of a 15A-style upper cover 50 and a bottom case 90 that corresponds to and aligns with 15A upper cover 50. A middle frame 86 is provided between the 15A upper cover 50 and bottom case 90. The middle frame 86 is provided with mounting brackets 82. The bottom case 90 is provided with at least one pair of socket terminals 84. The 15A upper cover 50 is provided with a first port 52 and a second port 54, which correspond to and align with the socket terminals 84. Protective door 42 is provided between middle frame 86 and 15A upper cover 50.

When the protective door 42 shelters first port 52 and second port 54, it is in the first position. When protective door 42 moves away from first port 52 and second port 54 to allow plug pins to contact socket terminals 84, it is in the second position.

The middle frame 86 is provided with a lock mounting guide plate 70 for cooperating with protective door 42, and protective door 42 is located on the lock mounting guide plate 70. Lock mounting guide plate 70 has ports 74 corresponding to and for aligning with first port 52 and second port 54. Moreover, ports 74 correspond to and can align with the socket terminals 84. At the front end of protective door 42, there is a first slope 46 corresponding to and for aligning with first port 52. At the rear end of protective door 42, a second slope 44 corresponds to and aligns with first port 54.

On 15A upper cover 50, a first notch 59 is provided on the inner side of first port 52. On first slope 46, a first lock block 66 corresponding to first notch 59 is provided. On 15A upper cover 50, a second notch 56 is provided on the inner side of second port 54. On second slope 44, a second lock block 64 corresponding to second notch 56 is provided. A third notch 72 is provided at the rear port 74 on lock mounting guide plate 70. Third lock block 69, corresponding to third notch 72, is provided on second slope 44.

Spring supporting shaft 48 is provided on the inner side of first slope 46. Spring locating plate 58, corresponding to and aligning with spring supporting shaft 48, is provided on 15A upper cover 50. Return spring 68 is provided between spring supporting shaft 48 and spring locating plate 58. Elevating jacking block 78 is provided between lock mounting guide plate 70 and protective door 42. Elevating spring 80 is provided between lock mounting guide plate 70 and elevating jacking block 78.

A protective door lock structured as above and installed in an electrical outlet can prevent insertion of foreign objects other than the electrical plug pins, achieving a protection function. Meanwhile, it has a simple structure and a low fabrication cost.

Figure 8A:
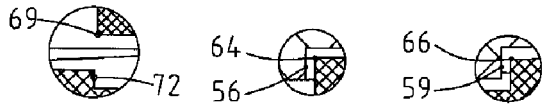
FIG. 8A is an exemplary schematic diagram of an embodiment before a plug is inserted.
Figure 8A:
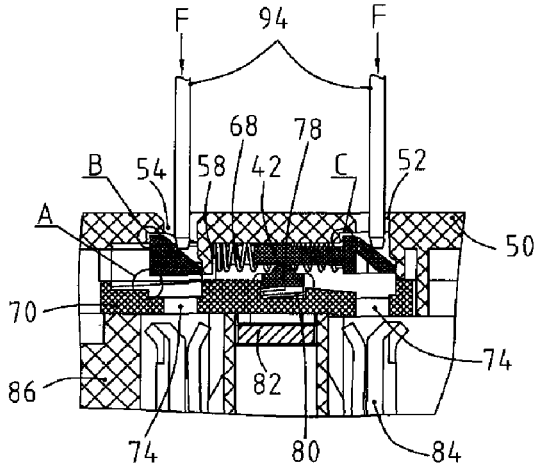

During the actual service of the door lock, as shown in FIG. 8A, when the plug pins 94 of a 15A plug are not inserted in, elevating spring 80 is in a compressive state, pushing the protective door 42 upwards and acting to automatically compensate for a pressure balance. This makes first lock block 66 be a blocking mechanism for first port 52 by seating first lock block 66 in the first notch 59. Second lock block 64 is a blocking mechanism for second port 54 by seating in the second notch 56.

When the plug pins 94 of a 15A plug are inserted into the first port 52 and the second port 54, they contact first slope 46 and second slope 44 and apply a vertical pressure and a horizontal component force on first slope 46 and second slope 44. Because first lock block 66 is in first notch 59 and second lock block 64 is in second notch 56, the horizontal component force is offset by the blocking function of first notch 59 and second notch 56. When first slope 46 and second slope 44 move downwards under the action of the vertical pressure they arrive at the middle cavity, and the horizontal component force exerted by plug pins 94 can not be offset. First slope 46 and second slope 44 move to the left and enter the middle cavity.

Figure 8B:
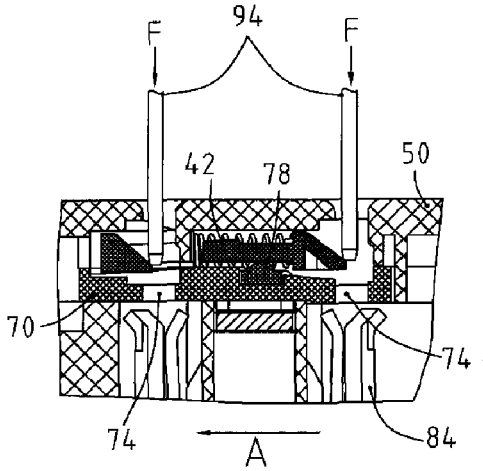
FIG. 8B is an exemplary schematic diagram of an embodiment after a plug is inserted.

In this process, protective door 42 pushes the top of elevating jacking block 78 downwards, compressing elevating spring 80. Then, protective door 42 moves to the left and compresses return spring 68. When it continues to push downwards, as shown in FIG. 8B, protective door 42 moves along Direction A and enters the cavity. The vertical pressure is compensated automatically by the pressure balance of elevating spring 80. Under the action of the horizontal pressure, protective door 42 continues to move along Direction A. Plug pins 94 penetrate out of port 74 of protective door 42 and contact with socket terminal 84 to electrify. When plug pins 94 are pulled out, protective door 42 recovers elastically under the action of elevating spring 80 and return spring 68, shielding the first port 52 and the second port 54.

Figure 9A:
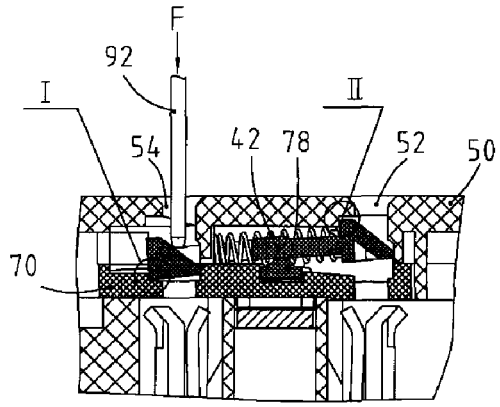
FIG. 9A is an exemplary schematic diagram of an embodiment when a foreign object is inserted into the second port.

As shown in FIG. 9A, when a foreign object 92 is inserted into second port 54, as shown in Position I, foreign object 92 contacts second slope 44 and pushes second slope 44 downwards. At this time, elevating spring 80 performs a pressure balance and provides automatic compensation to protective door 42. As shown in Position II, under the action of the pressure balance and automatic compensation, first lock block 66 on first slope 46 is clamped closely in first notch 59, making protective door 42 unable to move. When second slope 44 is further pushed down, first lock block 66 fits with first notch 59 more tightly. When second slope 44 is pushed down to the bottom position, third lock block 69 on second slope 44 is blocked in to the third notch 72 to further restrict the movement. Unless protective door 42 breaks, when a foreign object 92 is inserted into second port 54 protective door 42 will not be moved no matter how large a force is applied in any direction.

Figure 9B:
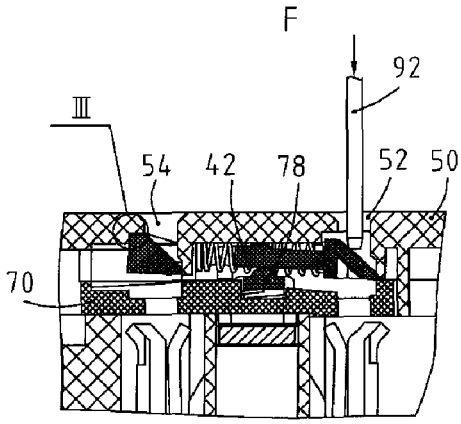
FIG. 9B is an exemplary schematic diagram of an embodiment when a foreign object is inserted into the first port.
Figure 10A:
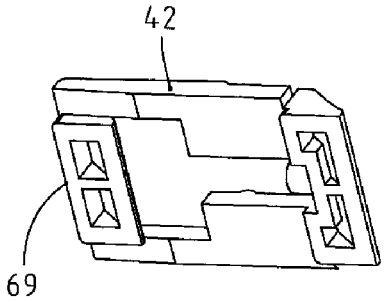
FIG. 10A is an exemplary bottom structural schematic diagram of a protective door.
Figure 10B:
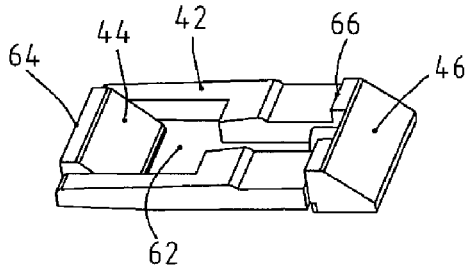
FIG. 10B is an exemplary schematic diagram of a protective door.
Figure 11A:
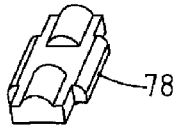
FIG. 11A is an exemplary schematic diagram of an elevating jacking block.
Figure 11B:
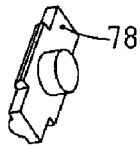
FIG. 11B is an exemplary bottom structural schematic diagram of an elevating jacking block.
Figure 12A:
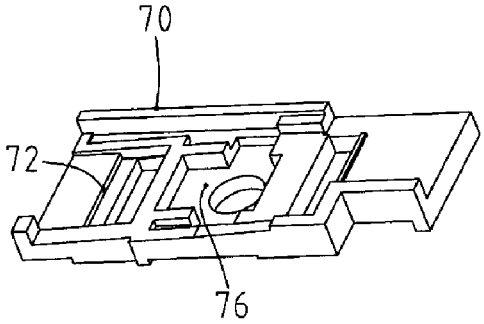
FIG. 12A is an exemplary structural schematic diagram of a lock mounting guide plate.
Figure 12B:
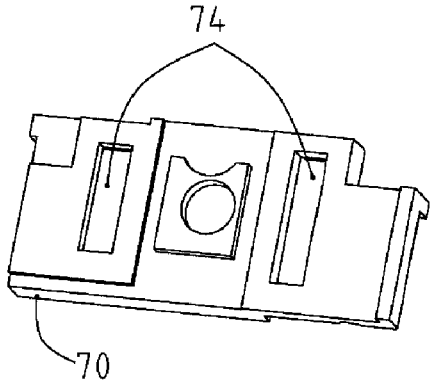
FIG. 12B is an exemplary bottom structural schematic diagram of a lock mounting guide plate.

As shown in FIG. 9B, when a foreign object 92 is inserted into the first port 52, foreign object 92 contacts first slope 46 and pushes first slope 46 downwards. At this time, elevating spring 80 performs a pressure balance and provides automatic compensation to protective door 42. As shown in Position III, under the action of the pressure balance and automatic compensation, second lock block 64 on second slope 44 is clamped closely in second notch 56, making protective door 42 unmovable. Second lock block 64 fits with second notch 56 more tightly. Unless protective door 42 breaks, it will not be moved no matter how large a force is applied in any direction.

With this door lock, a plug can be inserted easily when the insertion pressure is balanced, while foreign objects can not be inserted in any direction. This can prevent insertion of objects other than electrical plug pins, thereby achieving a protection function. Meanwhile, the door lock has a simple structure and a low fabrication cost.

In the preceding specification, various preferred embodiments have been described with reference to the accompanying drawings. It will, however, be evident that various other modifications and changes may be made thereto, and additional embodiments may be implemented, without departing from the broader scope of the invention as set forth in the claims that follow. The specification and drawings are accordingly to be regarded in an illustrative rather than restrictive sense.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

I claim:

1. An electrical socket with a locking protective door, comprising:

an upper cover comprising a first upper port and a second upper port;

a bottom case configured to cooperatively couple with the upper cover, the bottom case comprising at least one pair of socket terminals;

a middle frame between the upper cover and the bottom case, the middle frame comprising mounting brackets;

a protective door between the upper cover and the middle frame, the protective door comprising:

a front end with a first slope configured to selectively align with the first upper port; and a rear end with a second slope configured to selectively align with the second upper port; and a lock mounting guide plate coupled to the middle frame, the lock mounting guide plate comprising a first guide plate port and a second guide plate port, wherein the first upper port and the second upper port correspond to and vertically align with the at least one pair of socket terminals, wherein the first guide plate port and the second guide plate port correspond to and vertically align with the at least one pair of socket terminals, wherein, when the protective door is in a first position, the protective door prevents access to the first guide plate port and the second guide plate port, and wherein, when the protective door is in a second position, the protective door provides access to the first guide plate port and the second guide plate port.

2. The electrical socket of claim 1, wherein:

the upper cover further comprises a first notch provided on an inner side of the first upper port, the first slope connects to a first upper lock block, and the first upper lock block selectively couples with the first notch.

3. The electrical socket of claim 2, wherein:

the upper cover further comprises a second notch provided on an inner side of the second upper port, the second slope connects to a second upper lock block, and the second upper lock block selectively couples with the second notch.

4. The electrical socket of claim 3, wherein:

the first guide plate port further comprises a guide plate notch, the first slope connects to a lower lock block, and the lower lock block selectively couples with the guide plate notch.

5. The electrical socket of claim 1, wherein:

the first guide plate port further comprises a guide plate notch, the first slope connects to a lower lock block, and the lower lock block selectively couples with the guide plate notch.

6. The electrical socket of claim 2, wherein:

the first guide plate port further comprises a guide plate notch, the first slope connects to a lower lock block, and the lower lock block selectively couples with the guide plate notch.

7. The electrical socket of claim 1, further comprising:

a spring supporting shaft on an inner side of the second slope;

a spring locating plate on the upper cover; and a return spring supported between the spring supporting shaft and the spring locating plate.

8. An electrical socket with a locking protective door, comprising:

an upper cover comprising a first upper port and a second upper port;

a bottom case configured to cooperatively couple with the upper cover, the bottom case comprising at least one pair of socket terminals;

a middle frame between the upper cover and the bottom case, the middle frame comprising mounting brackets;

a protective door between the upper cover and the middle frame;

a lock mounting guide plate coupled to the middle frame, the lock mounting guide plate comprising a first guide plate port and a second guide plate port;

an elevating jacking block between the lock mounting guide plate and the protective door; and an elevating spring between the lock mounting guide plate and the elevating jacking block, wherein the first upper port and the second upper port correspond to and vertically align with the at least one pair of socket terminals, wherein the first guide plate port and the second guide plate port correspond to and vertically align with the at least one pair of socket terminals, wherein, when the protective door is in a first position, the protective door prevents access to the first guide plate port and the second guide plate port, and wherein, when the protective door is in a second position, the protective door provides access to the first guide plate port and the second guide plate port.

9. The electrical socket of claim 8, wherein the protective door comprises:

a front end with a first slope configured to selectively align with the first upper port; and a rear end with a second slope configured to selectively align with the second upper port.

10. The electrical socket of claim 9, wherein:

the upper cover further comprises a first notch provided on an inner side of the first upper port, the first slope connects to a first upper lock block, and the first upper lock block selectively couples with the first notch.

11. The electrical socket of claim 10, wherein:

the upper cover further comprises a second notch provided on an inner side of the second upper port, the second slope connects to a second upper lock block, and the second upper lock block selectively couples with the second notch.

12. The electrical socket of claim 11, wherein:

the first guide plate port further comprises a guide plate notch, the first slope connects to a lower lock block, and the lower lock block selectively couples with the guide plate notch.

13. The electrical socket of claim 9, wherein:

the first guide plate port further comprises a guide plate notch, the first slope connects to a lower lock block, and the lower lock block selectively couples with the guide plate notch.

14. The electrical socket of claim 10, wherein:

the first guide plate port further comprises a guide plate notch, the first slope connects to a lower lock block, and the lower lock block selectively couples with the guide plate notch.

15. The electrical socket of claim 9, further comprising:

a spring supporting shaft on an inner side of the second slope;

a spring locating plate on the upper cover; and a return spring supported between the spring supporting shaft and the spring locating plate.

* * * * *